United States Patent [19]

Hansen

[11] Patent Number: 4,692,104

[45] Date of Patent: Sep. 8, 1987

[54] ROTARY PUMPING APPARATUS WITH RADIAL SEAL ASSEMBLIES ON PISTON

[75] Inventor: Craig N. Hansen, Minnetonka, Minn.

[73] Assignee: Hansen Engine Corporation, Minnetonka, Minn.

[21] Appl. No.: 830,335

[22] Filed: Feb. 18, 1986

[51] Int. Cl.[4] ..... F04C 18/344; F04C 27/00; F04C 29/00

[52] U.S. Cl. ..... 418/61 R; 418/137; 418/138; 418/146; 418/148; 418/151; 418/264

[58] Field of Search ..... 418/61 R, 136–138, 418/146, 148, 151, 261, 264

[56] References Cited

U.S. PATENT DOCUMENTS

| | | | |
|---|---|---|---|
| 379,213 | 2/1903 | Tew . | |
| 732,671 | 6/1903 | Andrews | 418/146 |
| 2,345,561 | 4/1944 | Allen, Jr. | 418/146 |
| 2,423,507 | 7/1947 | Lawton . | |
| 3,196,856 | 7/1965 | Ward . | |
| 3,221,664 | 12/1965 | Jernaes . | |
| 3,743,451 | 7/1973 | Chapman | 418/61 R |
| 3,771,501 | 11/1973 | DeDobo . | |
| 3,787,150 | 1/1974 | Sarich | 418/61 R |
| 3,938,916 | 2/1976 | Sarich | 418/137 |
| 4,079,083 | 3/1978 | Sarich | 418/61 R |
| 4,219,315 | 8/1980 | Sarich | 418/61 R |
| 4,253,806 | 3/1981 | D'Amato | 418/61 R |

FOREIGN PATENT DOCUMENTS

| | | | |
|---|---|---|---|
| 794227 | 4/1981 | U.S.S.R. | 418/61 R |

*Primary Examiner*—John J. Vrablik

*Attorney, Agent, or Firm*—Burd, Bartz & Gutenkauf

[57] ABSTRACT

An air pump and compressor having a housing with a cylindrical internal chamber. A plurality of pairs of intake and exhaust valves mounted on the housing control the flow of air into and out of the chamber. A piston located within the chamber is mounted on a shaft rotated on the housing. The shaft has a primary eccentric that supports the piston in the chamber. A pair of secondary eccentrics spaced from the primary eccentric are mounted on the piston and housing to control the orbital movement of the piston. Seal assemblies slidably mounted in slots in the piston engage the inner cylindrical wall of the housing to form separate pumping chambers. Each pumping chamber is in communication with an intake valve and an exhaust valve so that on orbital movement of the piston the air flows into and is pumped out of each pumping chamber.

38 Claims, 16 Drawing Figures

ROTARY PUMPING APPARATUS WITH RADIAL SEAL ASSEMBLIES ON PISTON

FIELD OF INVENTION

The invention relates to devices for pumping fluids. The device is an orbit pump for compressing a gas, such as air.

BACKGROUND OF INVENTION

Rotary pumps have rotatable members including vanes for moving a fluid, such as air, through a compression chamber. These pumps have seal structures interposed between the movable and stationary parts to reduce leakage and enhance the compressors efficiency. The engaging parts of these rotary pumps are subject to high sliding speeds which may result in wear and considerable friction which limit the efficiency and useful life of the pumps. Examples of rotary piston compressors are shown in Lawton in U.S. Pat. Nos. 2,423,507 and Jerneas in 3,221,664.

SUMMARY OF THE INVENTION

The invention is directed to an apparatus for moving a fluid, such as a liquid or gas, in an economical and efficient manner. The apparatus has a housing having an inner cylindrical wall surrounding a chamber. Intake and exhaust valves are used to control the flow of fluid into and out of the chamber during the operation of the apparatus. A piston located within the chamber is moved relative to the housing. A first primary eccentric associated with the piston is used to move the piston and provide it with orbit motion. Secondary eccentric means is used in conjunction with the first eccentric means to control the movement of the piston within the chamber in such a manner to limit the piston's angular displacement. A plurality of seal assemblies arranged around the piston divide the chamber into separate arcuate chamber segments. The seal assemblies have blade or vane means that extend between the piston and the housing. During movement of the piston the seal assemblies have limited circumferential movement relative to the inner wall of the housing. The piston has a general radial movement relative to the seal assemblies. Each seal assembly and housing has cooperating structures allowing limited arcuate movement of the seal assembly and restricted radial movement thereof during movement of the piston. The seal assemblies have continuous and constant sealing engagement with the inner wall of the housing. The movement of the piston sequentially draws the fluid into the chamber segments from an external source such as ambient air and discharges the air under pressure into a receiver. The receiver can be a manifold or line for carrying the fluid.

A preferred embodiment of the apparatus has a plurality of pairs of intake and exhaust valves mounted on the housing for controlling a flow of fluid into and out of the chamber segments. A piston located within the chamber is mounted on a shaft rotatably mounted on the housing. The shaft is a first eccentric member that extends through a generally central bore in the piston whereby the rotation of the shaft will move the piston relative to the housing to affect the pumping of the fluid through the chamber. Additional eccentric members rotatably cooperate with the first eccentric member to limit the angular movement of the piston during the rotation of the shaft. A plurality of seal assemblies are arranged around the piston to divide the chamber into chamber segments and locate the seal assemblies between each pair of the intake and exhaust valves. The seal assemblies have vane means associated with the housing to permit arcuate movement of the vane means and restrict radial movement with respect to the housing thereof during the orbital movement of the piston. The seal assemblies may have pairs of blades or vanes located in generally radial slots in the piston. The slots are circumferentially spaced around the piston. The circumferential space between adjacent seal assemblies can be equal or vary to provide selected working volumes for the chamber segments. Each blade has engaging adjacent side surfaces and outer ends. The outer ends have transverse grooves which accommodate seal members. The seal members are located in sliding and sealing engagement with the inner cylindrical wall of the housing. A cross bar attached to each blade has outer ends located in arcuate slots in the end plates of the housing. The arcuate slots cooperate with the outer ends of the cross bars to allow the blades to move relative to each other and have limited arcuate movement and restrict radial movement with respect to the housing thereof. This insures a uniform and constant sealing contact between the seal members and the inner cylindrical wall of the housing. The seal members have relatively low sealing frictional engagement with the inner cylindrical wall of the housing and relatively low sliding speeds as compared to other constant displacement devices. The anchoring of the vanes on the housing minimizes the centrifugal force on the seal members and vanes thereby reducing sealing friction. This results in an effective seal having a long useful wear life.

These and other advantages of the apparatus and seal assembly of the invention are shown in the drawings and described in the following specification.

DESCRIPTION DRAWING

DESCRIPTION OF PREFERRED EMBODIMENT

Referring to FIGS. 1 to 4, there is shown the pumping apparatus of the invention indicated generally at 20 operable to compress and pump gas, such as air, and deliver the compressed gas to a desired location. Apparatus 20 is operable to pump fluids including liquids, gases and fluid-like materials. The following description is directed to an apparatus for pumping air. Apparatus 20 efficiently compresses the air with minimum of vibration and wear on its operative parts. The moving and sealing components of apparatus 20 have low sliding speeds and low sealing friction which improves the pumping and compression efficiency and wear life of the apparatus.

Figure 1:
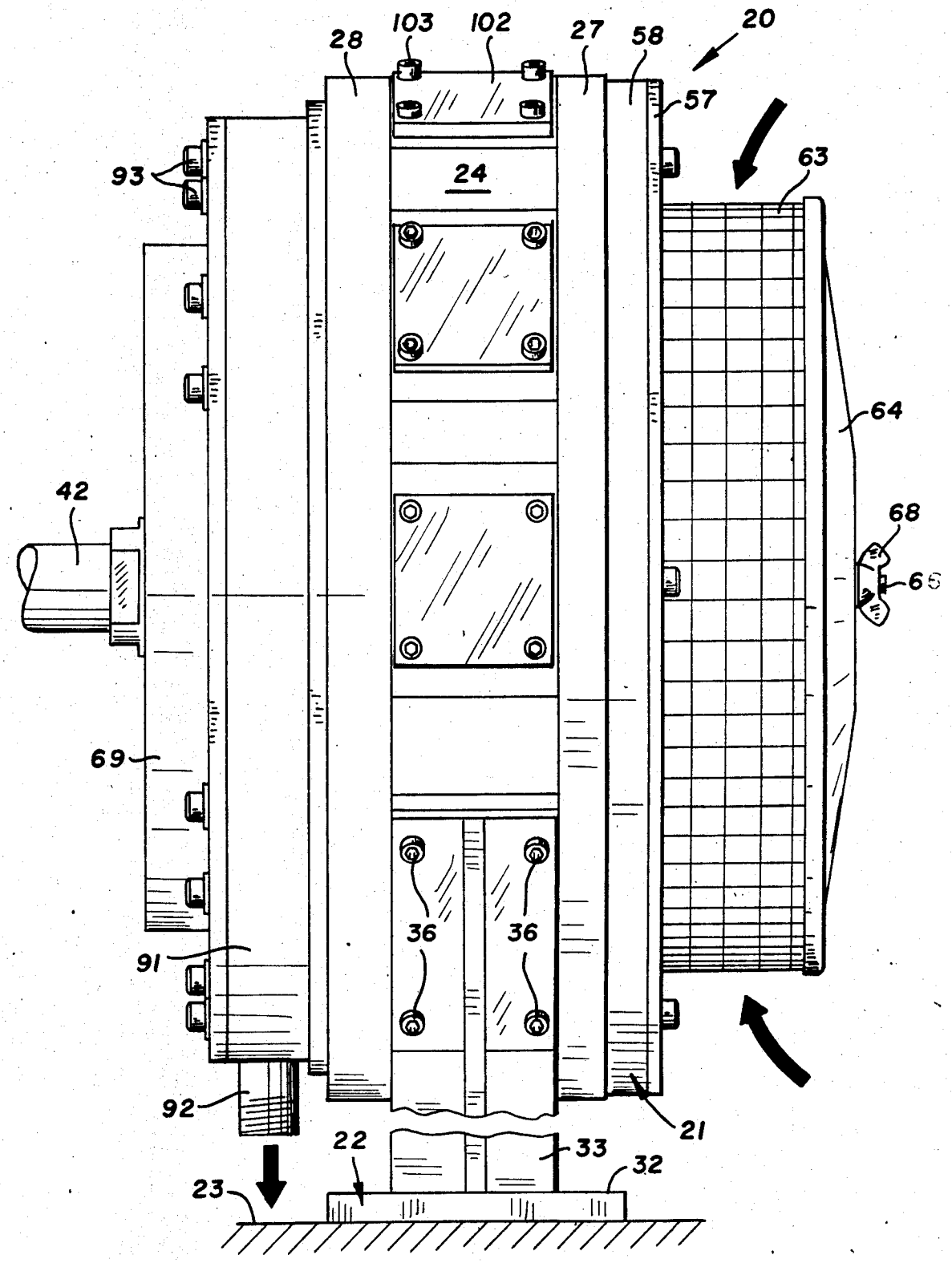
FIG. 1 is a side elevational view of the orbit gas compressor of the invention.
Figure 2:
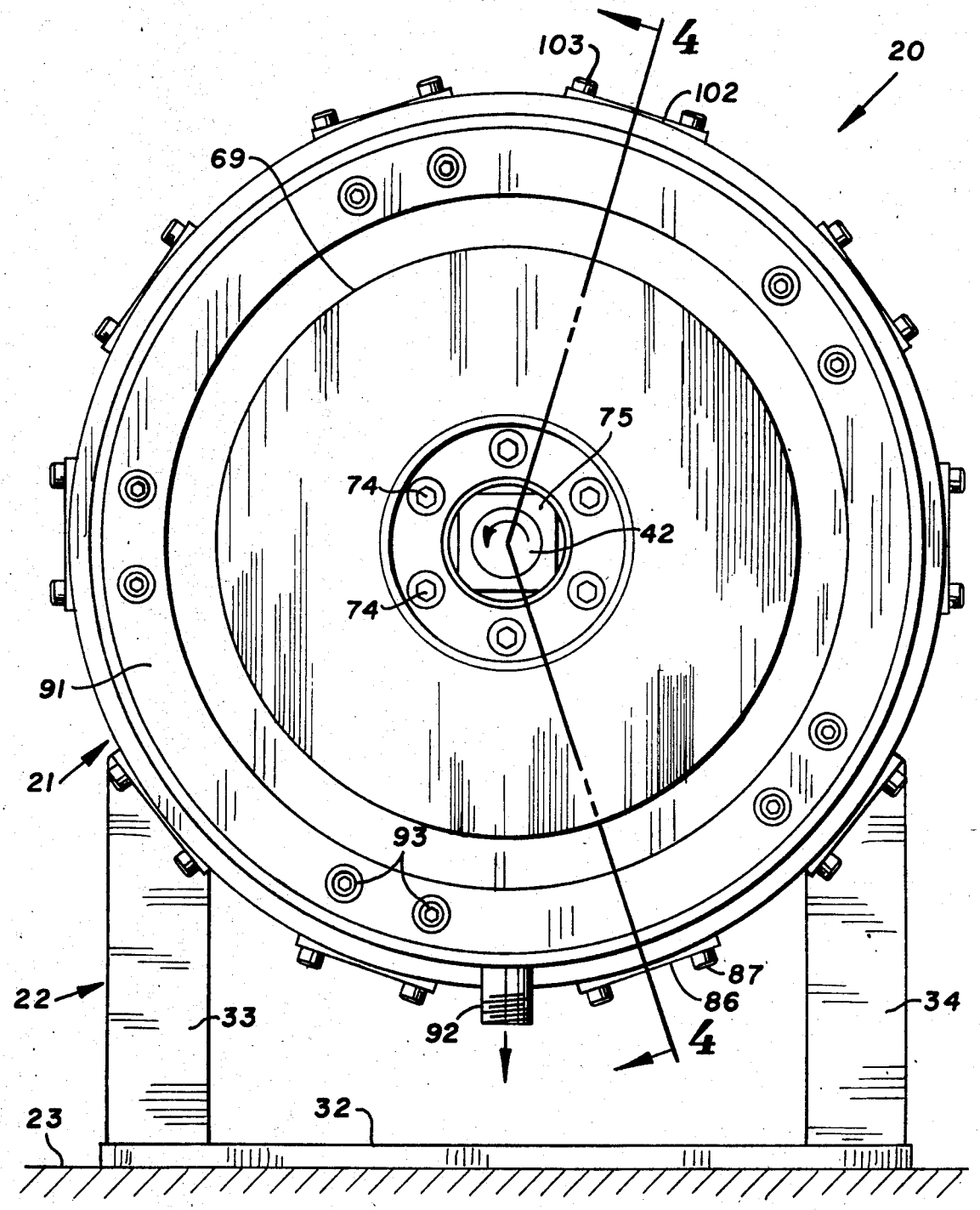
FIG. 2 is a side view of the left side of FIG. 1.
Figure 3:
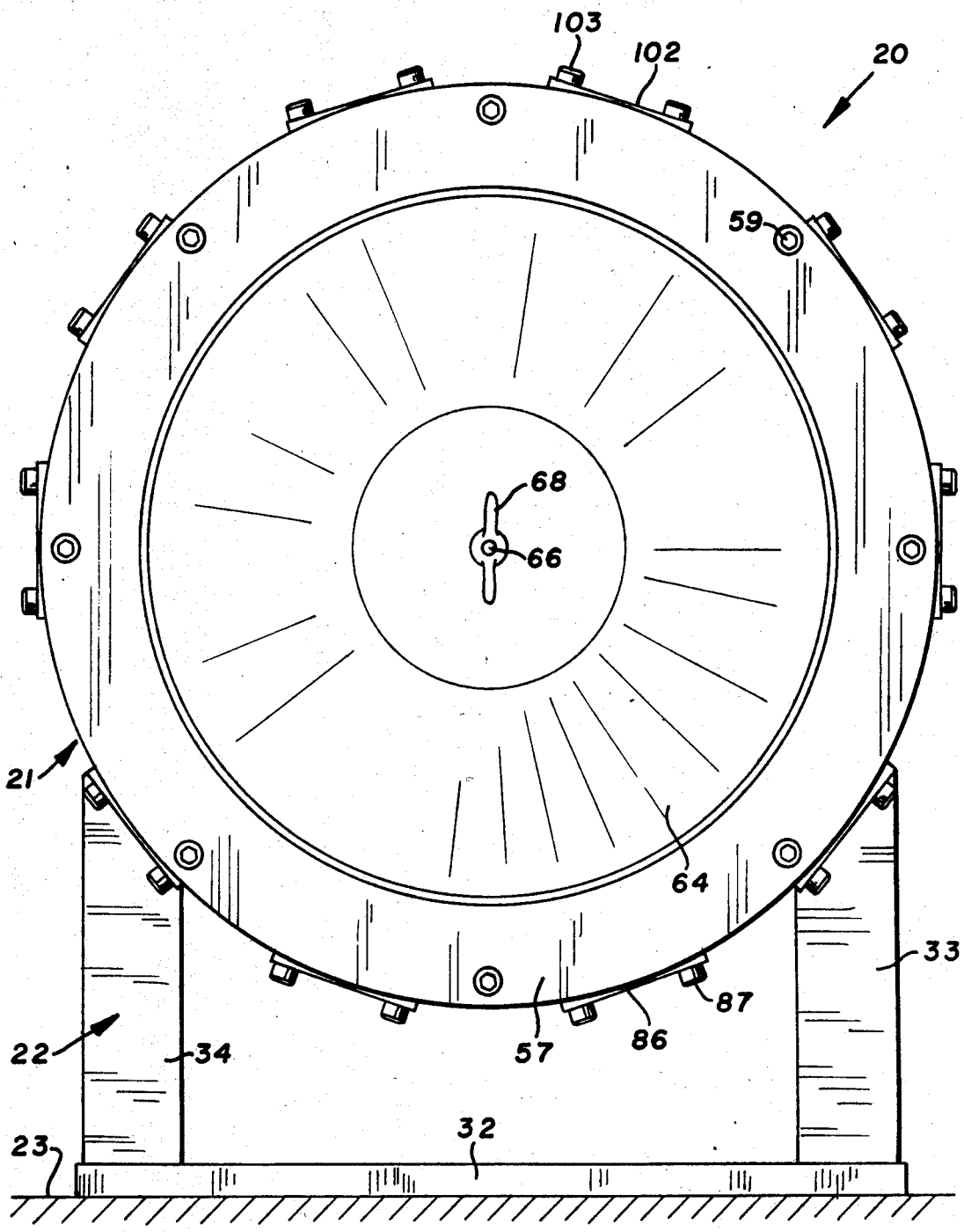
FIG. 3 is a side view of the right side of FIG. 1.

Apparatus 20 has an annular housing indicated generally at 21 secured to a supporting frame 22. Frame 22 is attached to fixed base 23 or similar support. Frame 22 has a generally horizontal plate 32 adapted to be secured to base 23. A pair of upright legs 33 and 34 secured to the top of plate 32 engage opposite portions of housing 21. As shown in FIG. 1, a plurality of bolts 36 secure the upper ends of the leg 33 to housing 21. Leg 34 is secured to housing 21 in a similar manner. Other types of frame can be used to support the apparatus in its working environment.

Figure 4:
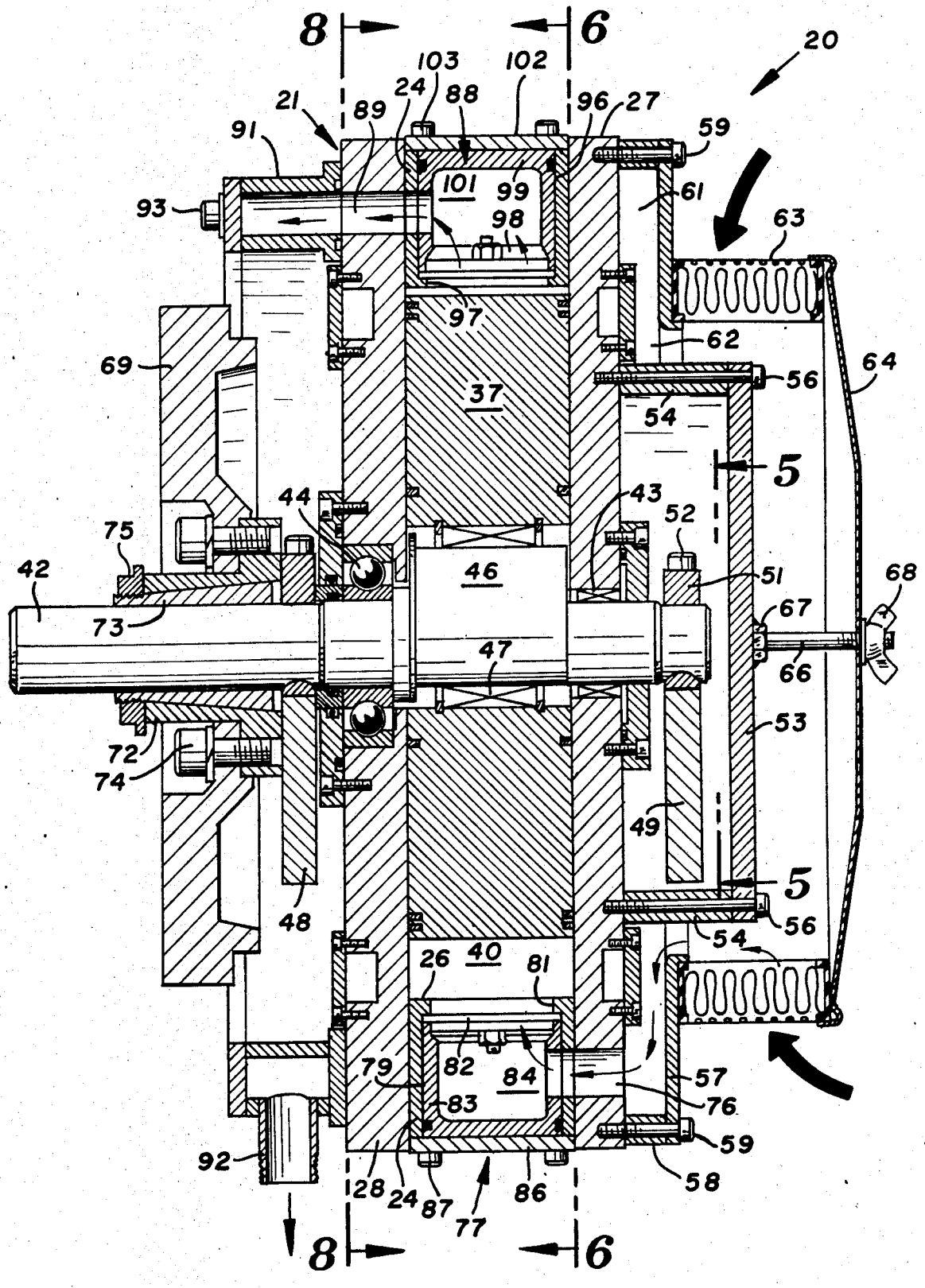
FIG. 4 is an enlarged sectional view taken along the line 4—4 of FIG. 2.
Figure 6:
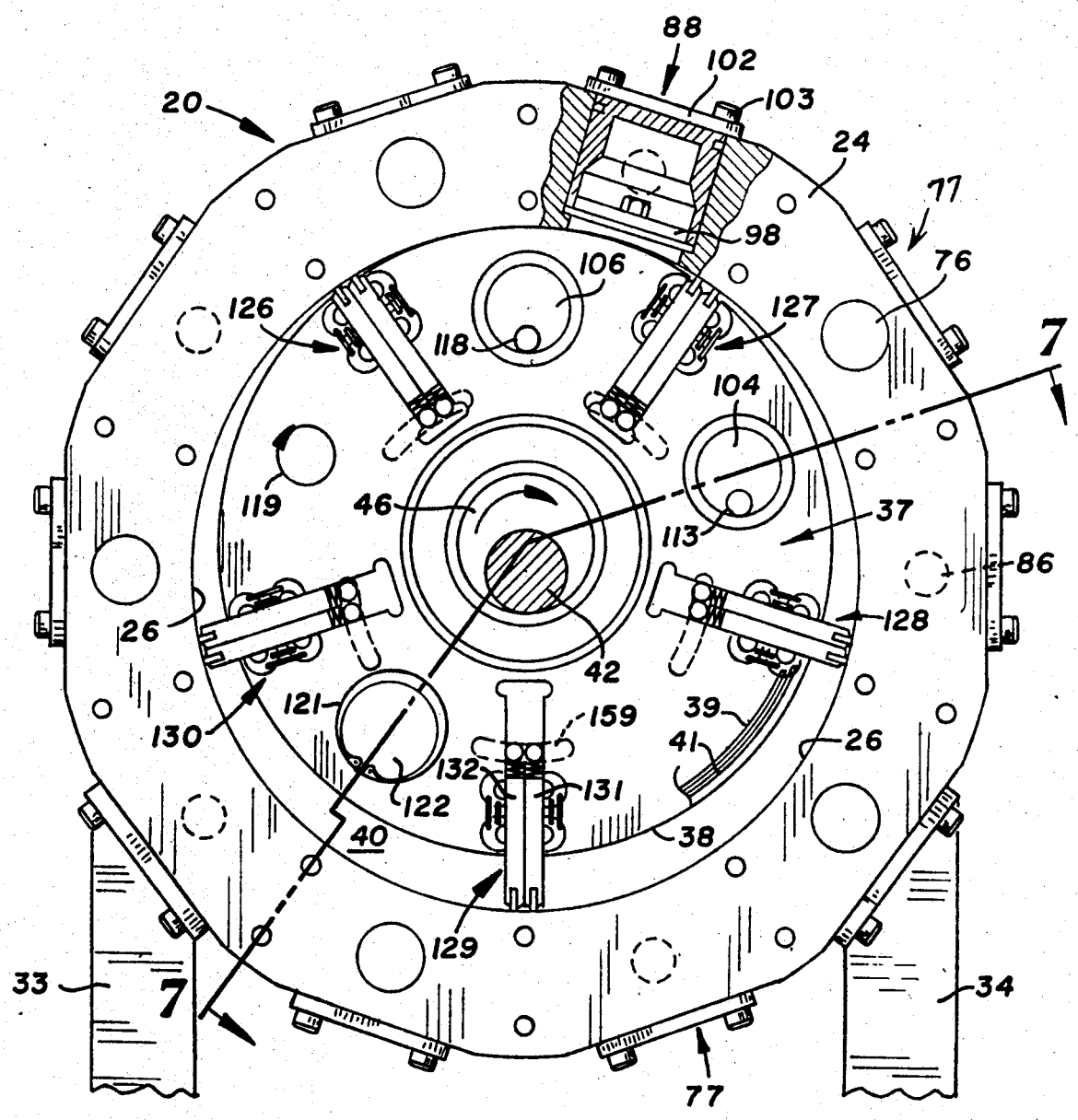
FIG. 6 is a reduced scale sectional view taken along the line 6—6 of FIG. 4.
Figure 7:
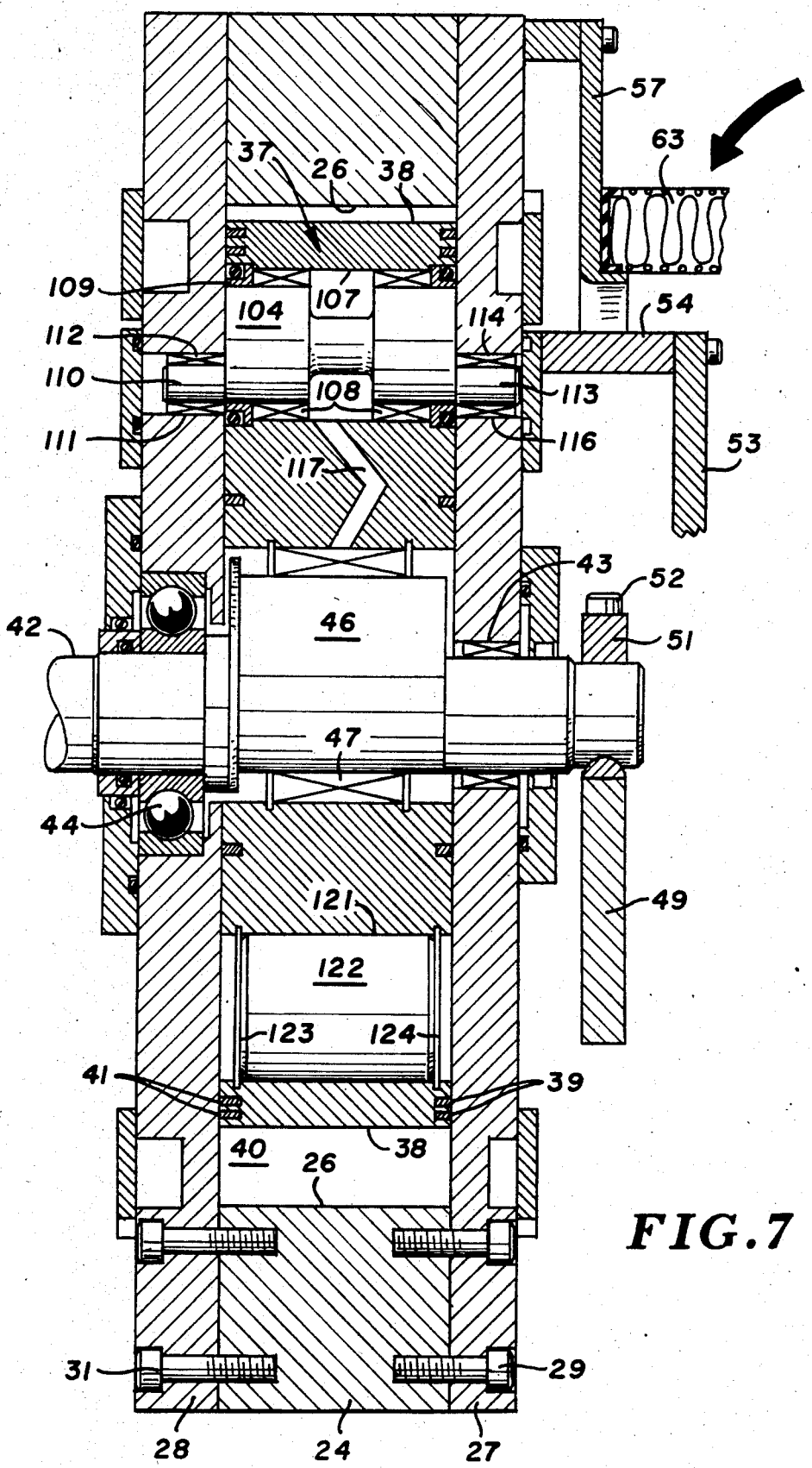
FIG. 7 is an enlarged sectional view taken along the line 7—7 of FIG. 6.

As shown in FIGS. 4, 6 and 7, housing 21 has a circular body 24 having an internal cylindrical wall 26. End plates 27 and 28 are secured to opposite sides of body 24 with bolts 29 and 31. A cylindrical piston or orbitor, indicated generally at 37, is located in chamber 40. Piston 37 has an outer cylindrical surface 38 and a diameter smaller than the diameter of the cylindrical wall 26 of body 24. Surface 38 and cylindrical wall 26 are shown circular but need not be and are machined with conventional machine tools. Pairs of arcuate segment side seals 39 and 41 carried by piston 37 adjacent surface 38 engage the inside surfaces of end plates 27 and 28 to minimize the leakage of gas from compression chamber 40. Piston 37 is mounted on a shaft 42. As shown in FIG. 4, a first bearing 43 rotatably mounts one end of shaft 42 on end plate 27. A second bearing 44 rotatably mounts the opposite end of shaft 42 on end plate 28. The portion of shaft 42 between end plates 27 and 28 has an enlarged cylindrical eccentric journal or hub 46. A bearing 47 surrounding hub 46 rotatably supports piston 37 on hub 46.

Figure 5:
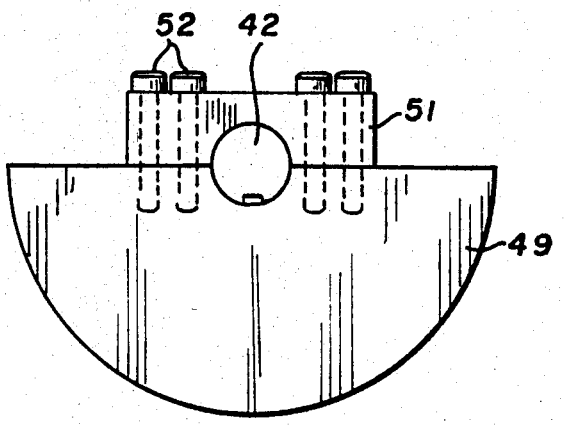
FIG. 5 is a sectional view taken along the line 5—5 of FIG. 4.

A pair of counter weights 48 and 49 are mounted on shaft 42 adjacent opposite sides of the end plates 27 and 28 to dynamically balance shaft 42 and piston 37. Counter weight 49, as shown in FIG. 5, has a generally semi-circular shape. A cap 51 located over shaft 42 is secured to counter weight 49 with a plurality of bolts 52. A key or spline is used to index counter weight 49 to shaft 42 to balance the system. Counter weight 48 is secured to shaft 42 in a similar manner. Referring to FIG. 4, a disk 53 is located adjacent an end of shaft 42 and counter weight 49. A cylindrical tube 54 space plate 53 from end plate 27 providing a confined space for rotating counter weight 49. A plurality of bolts 56 extended through tube 54 securing plate 53 to end plate 27.

A generally flat annular member 57 is spaced laterally from end plate 27 with a ring 58. A plurality of bolts 59 secure member 57 and ring 58 to the outside of end plate 27. The space between annular member 57 and end plate 27 is an air inlet chamber having a mouth or opening 62. An annular air filter 63 surrounds opening 62. Filter 63 is a conventional ring filter having a filter element. A circular cover 64 is mounted on the outside of filter 63. A bolt 66 threaded into a nut 67 mounted on the center of disk 53 extends through a center hole in cover 64. A wing nut 68 on bolt 66 retains cover 64 and filter 63 in assembled relation with annular member 57.

A fly wheel 69 is attached to shaft 42 with a cylindrical collar 72 located about a sleeve 73. Sleeve 73 is located in tight gripping engagement with shaft 42. Collar 72 and sleeve 73 having engaging tapered surfaces. A nut 75 threaded on sleeve 73 in engagement with the outer end of collar 72 holds collar 72 on sleeve 73 and sleeve 73 on shaft 42. A plurality of bolts 74 secure fly wheel 69 to collar 72. An external source of power (not shown), such as electrical motor or internal combustion engine, is coupled to shaft 42 to rotate fly wheel 69 and shaft 42.

End plate 27 has an air inlet passage 76 leading to an air inlet valve assembly indicated generally at 77. Valve assembly 77 is a one way valve operable to allow air to flow into the chamber 40 as indicated by the arrows in response to the orbital movement of piston 37. Valve assembly 77 includes a circular sleeve 83 located in a bore 79 in body 24. Body 24 has an internal inwardly directed lip 81 engageable with a valving member 82. Valving member 82 is mounted on the open end of a cup-shaped sleeve 83 located within bore 79. Housing 83 has a chamber 84 open to hold the valve assembly in assembled relation with body 24. A plurality of bolts 87 secure cover 86 to body 24. Bolts 87 can be removed allowing cover 86 as well as the entire valve assembly to be withdrawn from body 24 for servicing and replacement.

Apparatus 20 has an exhaust valve assembly indicated generally at 88 operable to allow compressed air to flow into an outlet passage 89 which leads to an annular manifold 91. Manifold 91 has a gas outlet connection 92 adapted to be connected to a gas receiver such as a tank, gas line or the like. A plurality of bolts 93 secure manifold 91 to the outside of end plate 28.

Valve assembly 88 has a sleeve 99 located within a radial bore 96 in body 24. Body 24 has a inwardly directed annular lip 97 supporting a valving member 98. The valving member 98 is movably mounted in a cup-shaped sleeve 99 positioned within bore 96. Sleeve 99 has a chamber 101 which accommodates valving member 98 and is open to outlet passage 89. A cover 102 fits over sleeve 99. A plurality of bolts 103 attach cover 102 to body 24. Bolts 103 can be removed so that cover 102 as well as the valve assembly can be withdrawn from body 24 for servicing and replacement. Apparatus 20 has five pair of inlet and exhaust valve assemblies mounted in body 24. Inlet valve assembly 77 and exhaust valve assembly 88 are commercial one-way valves, such as reed, plate or disk valves.

Referring to FIG. 6, piston 37 is operatively associated with a pair of eccentric members 104 and 106 which control the orbital movement of piston 37 during rotation of shaft 42. As shown in FIG. 7, eccentric 104 is located within a bore 107. Roller bearings 108 located in bore 107 rotatably mount eccentric 104 in piston 37. Oil seals 109 surround opposite ends of eccentric 104 adjacent opposite ends of bearings 108. Eccentric 104 has a pair of outwardly directed shafts 110 and 113 rotatably mounted on end plates 28 and 27. Shaft 110 fits into a bore 111. Roller bearings 112 support shaft 110 in bore 111. Shaft 113 fits into a bore 114 and is rotatably mounted therein with roller bearings 116. The axis of rotation of shafts 110 and 113 is laterally offset from the axis of eccentric 104. Piston 37 has a lubricating oil passage 117 connecting the mid-section of bore 107 and the mid-section of the central passage accommodating the bearing 47. Returning to FIG. 6, eccentric 106 is identical in structure to eccentric 104. Eccentric 106 is angularly spacd about 70 degrees from eccentric 104. Eccentric 106 has oppositely directed stub shafts 118 that rotatably mount the eccentric 106 on end plates 27 and 28. The eccentrics 104 and 106 control the orbital movement of piston 37 as indicated by the arrow 119 such that no angular displacement with respect to the housing occurs on the piston.

Piston 37 has a bore 121 located midway between the bores for the eccentrics 104 and 106. A cylindrical counter weight 122 is located in bore 121 to compensate for the mass of eccentrics 104 and 106 thereby balancing piston 37. As shown in FIG. 6, a plurality of snap rings 123 and 124 retain weight 122 in bore 121.

A plurality of seal assemblies indicated generally at 126, 127, 128, 129 and 130 are circumferentially spaced about orbitor 37. Seal assemblies 126–130 divide chamber 40 into separate compression chamber segments or working volumes. Each chamber segment is an air pumping volume. As shown in FIG. 6, apparatus 20 has five pumping volumes located between the adjacent seal assemblies. The number of pumping volumes can vary. Intake and exhaust valve assemblies are in communication with each pumping volume to control the flow of air into and out of the pumping volume.

Figure 8:
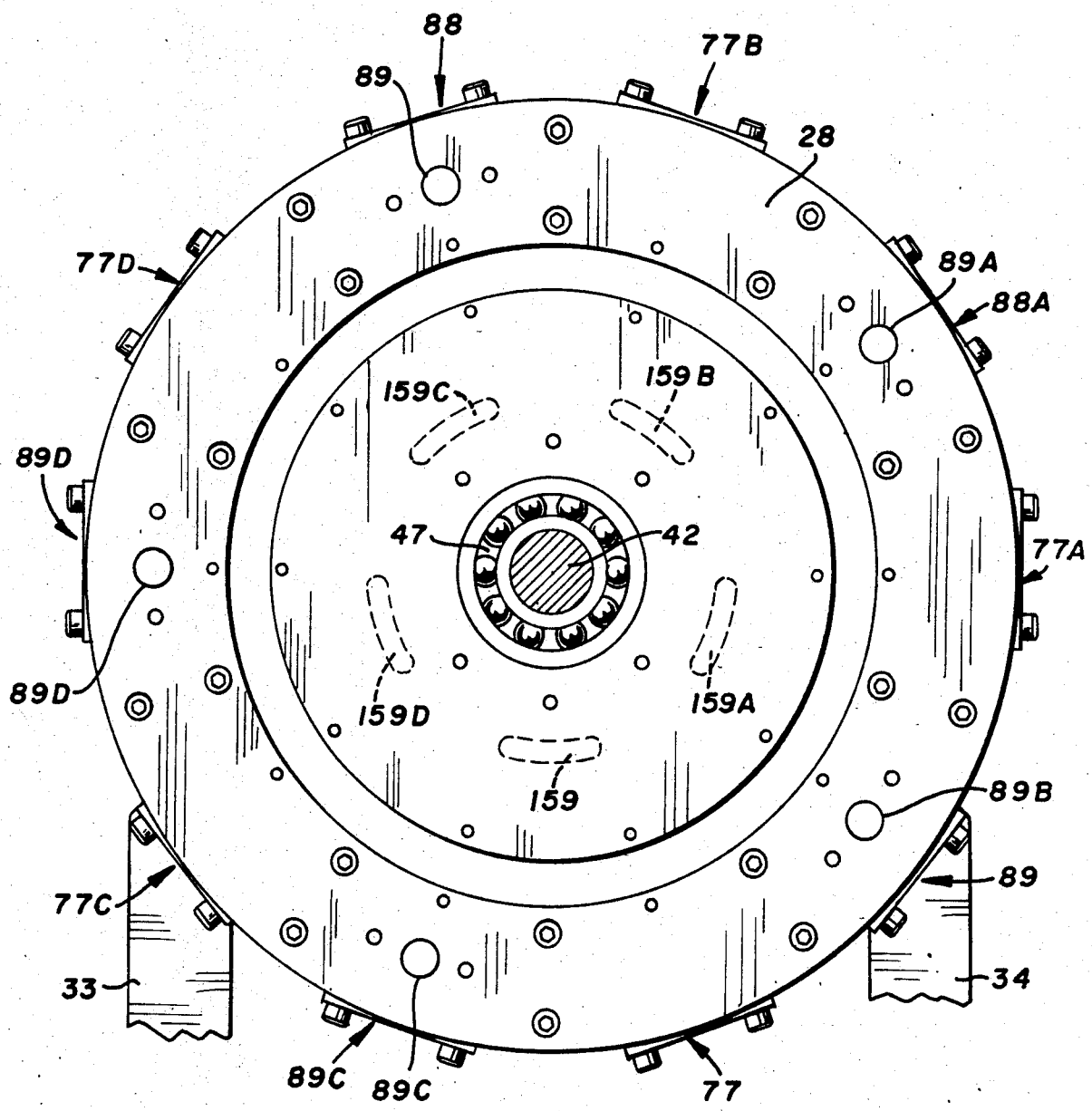
FIG. 8 is a reduced scale sectional view taken along the line 8—8 of FIG. 4.
Figure 10:
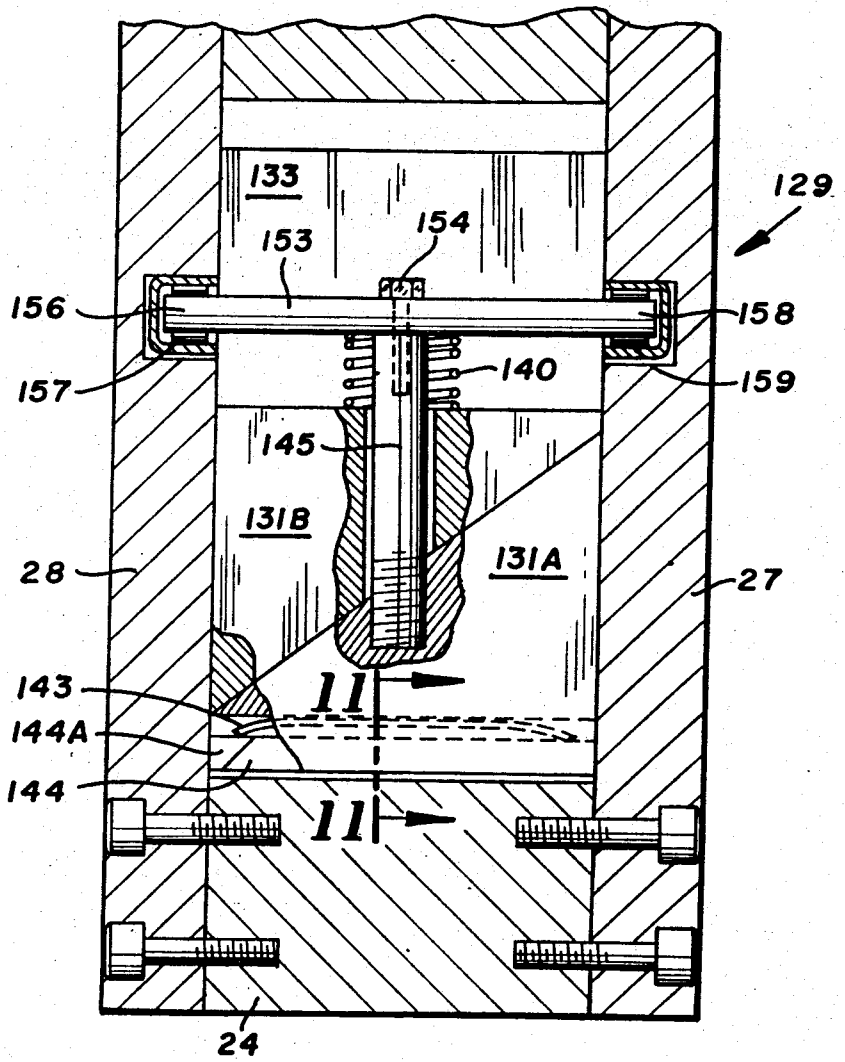
FIG. 10 is an enlarged sectional view taken along line 10—10 of FIG. 9.
Figure 9:
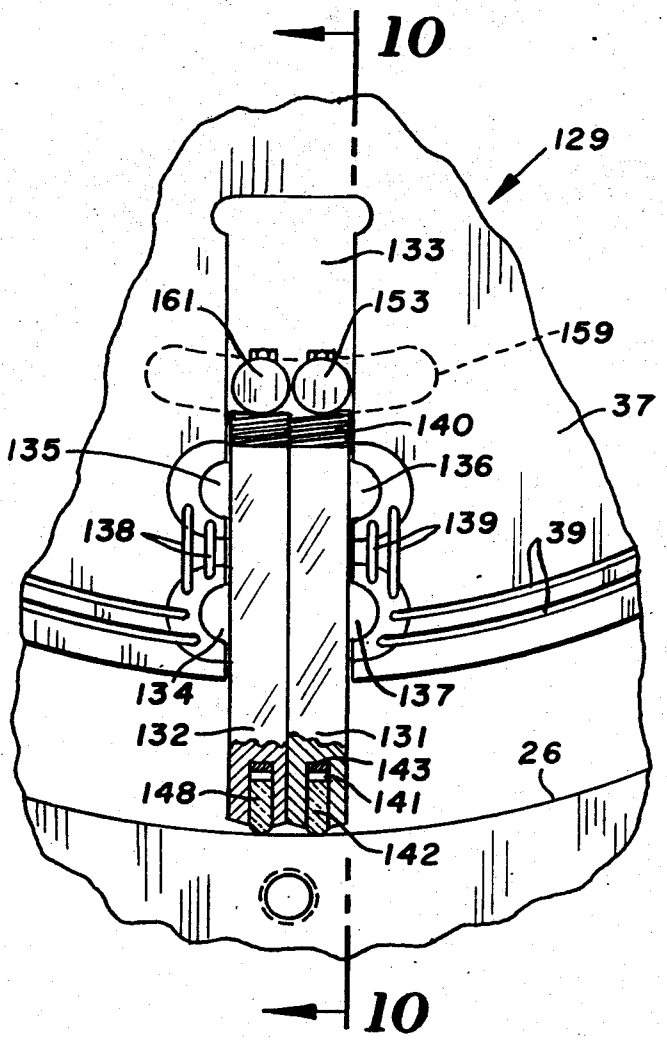
FIG. 9 is an enlarged elevational view, partly sectioned, of a seal assembly as shown in FIG. 6.
Figure 11:
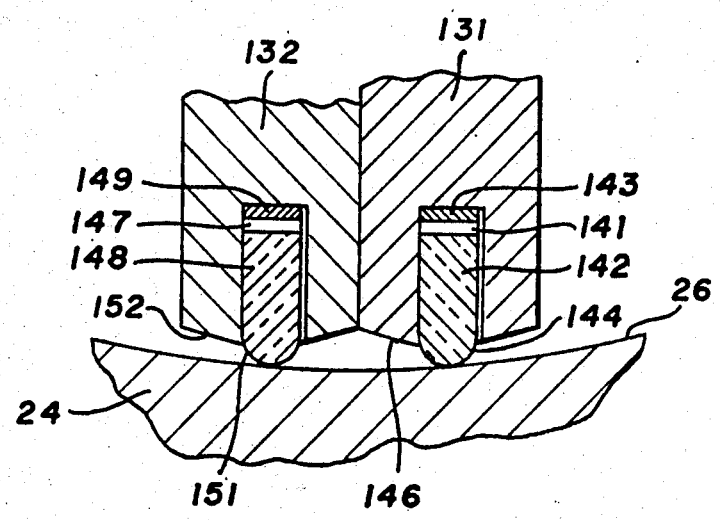
FIG. 11 is an enlarged sectional view taken along the line 11—11 of FIG. 10.

Seal assemblies 126–130 are identical in structure. They have limited circumferential movement relative to inner wall 26 of body 24 and restricted radial movement relative to body 24. The seal assemblies 126–130 are in sliding sealing engagement with the inner cylindrical wall 26 of body 24. This engagement is continuous and substantially constant. The following description is limited to seal assembly 129. Referring to FIG. 9, seal assembly 129 has a pair of generally flat vanes or blades 131 and 132 located within a radial slot 133 in piston 37. The side walls of the slot accommodate transverse seal members 134, 135, 136 and 137. First seal strips 138 interconnect seal members 134 and 135. Second seal strips 139 interconnect seal members 136 and 137. Vane 131, as shown in FIG. 10, has two generally triangular members 131A and 131B. The members 131A and 131B have engaging diagonal surfaces which allow the members to move in opposite outward directions. The outer side edge of member 131A engages plate 27. The outer side edge of member 131B engages plate 28. Vane 131 has a slot 141 across the width of the outer end thereof accommodating a seal 142. Seal 142 can be made of ceramic material. An eliptical spring 143 located in the base of slot 141 biases the rounded outer end 144 of seal 142 into engagement with inner wall 26 of body 24. The outer end of vane 131 has a chamfer 146. The chamfer 146 allows the vane 131 to have limited angular movement or tilt without engaging the inner wall 26 of body 24. Vane 132 is located in side surface engagement with vane 131. Vane 132 has a slot 147 across the width of the outer end thereof accommodating a seal member 148. A spring 149 in the base of the groove 147 biases the outer end 151 of seal member 148 into sealing engagement with the inner wall 26 of housing 24. Vane 132 has a chamfered outer end 152 which allows the vane limited angular movement or tilt which allows the vanes to move without contacting the inner wall 26 of body 24. Vane 131 is attached with a bolt or pin 145 to a cross bar 153. A bolt 154 secures pin 145 to the mid-section of bolt 154. Pin 145 extends through a hole in blade member 131B and is anchored to member 131A. A compression spring 140 disposed about pin 145 engages vane member 131B and pin 153. Spring 140 biases members 131A and 131B toward each other and maintains the members 131A and 131B in engagement with end plates 27 and 28. Other means can be used to secure the cross bar 153 to vane 131. Cross bar 153 and vane 131 can be a one-piece member. Bar 153 has a first end 156 located in an arcuate slot 157 in the end plate 28. The opposite end 158 of bar 153 is located in an arcuate slot 159 in end plate 27. Needle bearings rotatably mount ends 156 and 158 in slots 157 and 159. As shown in FIG. 8, end plate 27 has a plurality of arcuate slots 159, 159A, 159C, and 159D circumferentially arranged about shaft 42 for the ends of the bars of the seal assemblies. The radius length of each of the slots 157 and 159 is the same as the radius of inner wall 26 of body 24. In other wrods, the arcuate curve or cam track of slot 159 is the same as the arcuate curve of inner wall 26 of body 24. This relationship ensures restricted radial movement of vanes 131 and 132 relative to inner wall 26 of body 24 during orbital movement of piston 37. The arcuate slots 157 and 159 allow seal assembly 129 limited movement during orbital movement of piston 37. In a like manner, a transverse bar 161 is secured to the inner end of blade 132. Bar 161 has opposite ends located in the slots 157 and 159. Bar 161 carries the gas load and small centrifugal load associated with seal assembly 129.

In use, apparatus 20 is operated by driving shaft 42 with an external power source, such as an electric motor or an internal combustion engine. Rotation of shaft 42 causes the primary eccentric 46 to rotate about the axis of shaft 42. This causes piston 37 to have orbital motion in the amount determined by distance between the axis of rotation of shaft 42 in the axis of the eccentric 46. The secondary eccentrics 104 and 106 limit the angular movement of piston 37 causing the peripheral segments of the outer surface 38 of piston 37 to sequentially move toward and away from the inner cylindrical wall 26 of the body 24. This results in a pumping action causing the air to flow through each chamber segment. The air is drawn into a chamber segment through the inlet valve assembly 77 as shown by the arrows in FIG. 4. The piston 37, when moved toward the cylindrical inner wall 26 forces the air in the chamber segment out through the exhaust valve associated with the chamber. The air flows through the outlet passages 89–89D into manifold 91. The compressed air in manifold 91 flows through the gas outlet 92 to a receiver such as a tank or air line.

The seal assemblies 126–130 are in constant and generally uniform sealing engagement with the inner cylindrical wall 26. The seal assemblies divide chamber 40 into separate pumping chamber segments. Each chamber segment is open to an intake valve assembly and an exhaust valve assembly. The seals 142 and 148 are maintained in sliding frictional contact with the inner wall 26 and have limited circumferential movement relative thereto. Vanes 131 and 132 are movably mounted on the end plates 127 and 128 through the cooperating means of the arcuate slots 157 and 159 and the ends of the cross bars 153 and 161. All of the seal assemblies are located in circumferential spaced generally radial slots in piston 37 so that the piston moves relative to the seal assemblies. This minimizes the centrifugal force on the seal assemblies thereby reducing the variations in the sealing loads on the vanes. The seal assemblies have low sliding speeds and low sealing friction. This improves the pumping and compression efficiency as well as the wear life of the seal assemblies.

Referring to FIGS. 12 to 16, there is shown a modification of the seal assembly, indicated generally at 200 for use with piston 37 located in chamber 40. A plurality of seal assemblies 200 are circumferentially spaced around the piston in lieu of seal assemblies 126–130 shown in FIG. 6. The following description is directed to a single seal assembly 200 as the remaining seal assemblies have the same structure and function.

Figure 12:
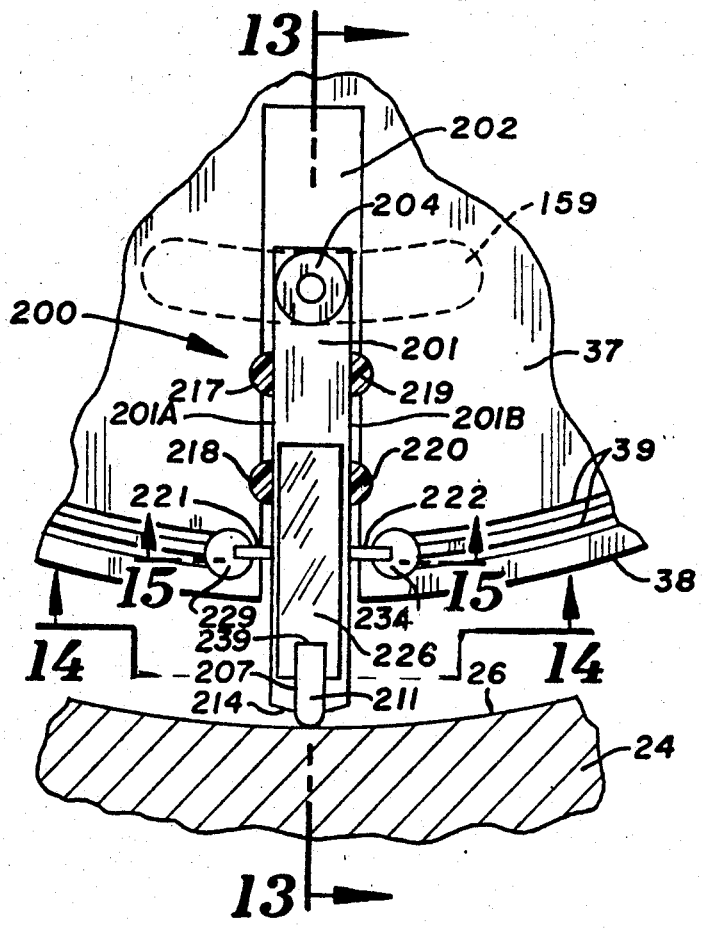
FIG. 12 is an elevational view similar to FIG. 9 of a modification of the seal assembly.

Seal assembly 200 mounted on piston 37 is located in continuous sliding sealing engagement with the inner surface 26 of body 24. Piston 37 has a radial slot 202 slidably accommodating a generally flat blade or vane 201 having opposite flat sides 201A and 201B. A bar 203, shown as a cylindrical rod, extends transversely through the inner end of blade 201. Rollers 204 and 206 are mounted on the ends of bar 203. Side plates 27 and 28 of housing 21 have arcuate slots 157 and 159 providing tracks or cam surfaces for rollers 204 and 206. The arcuate length and shape of slot 159 is shown in FIG. 12. Slot 157 has the same arcuate length and shape. The slots 157 and 159 are concentric with the inside cylindrical surface 26 of body 24. Arcuate slots 157 and 159 positively positions seal assembly 200 during orbital movement of piston 37 and maintain seal assembly 200 in continuous sealing contact with inner surface 26 of body 24.

Figure 13:
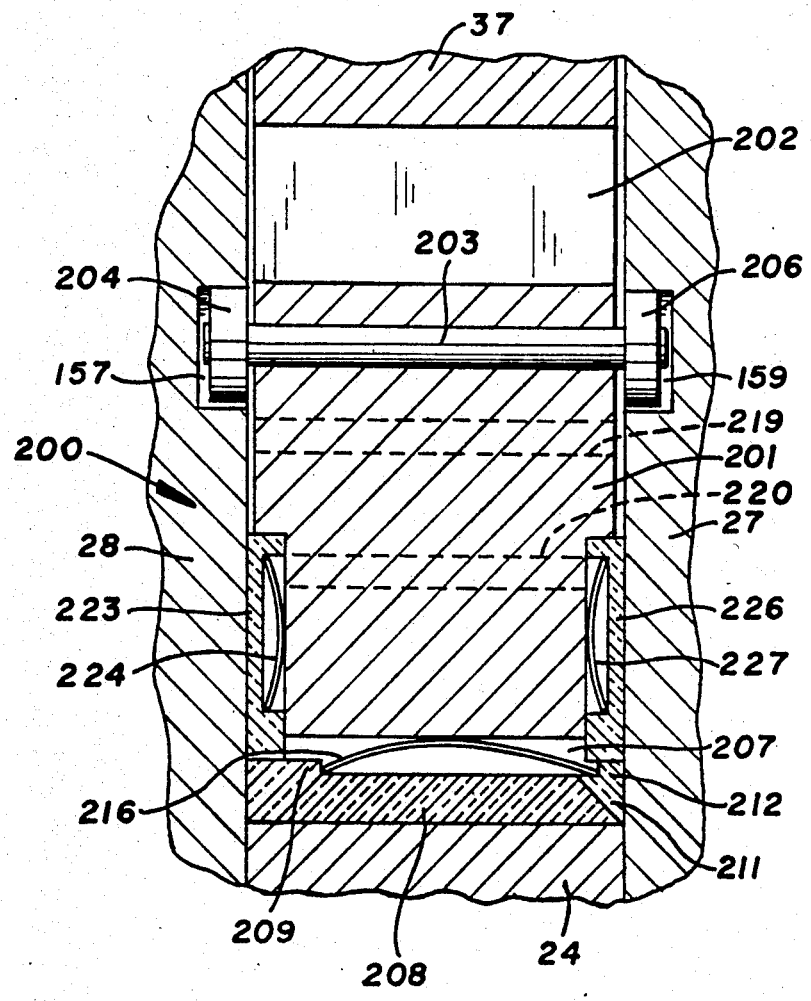
FIG. 13 is a sectional view taken along line 13—13 of FIG. 12.
Figure 14:
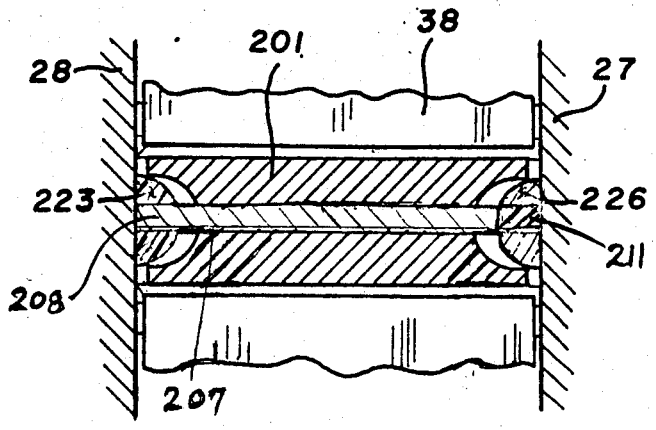
FIG. 14 is a sectional view taken along line 14—14 of FIG. 12.
Figure 15:
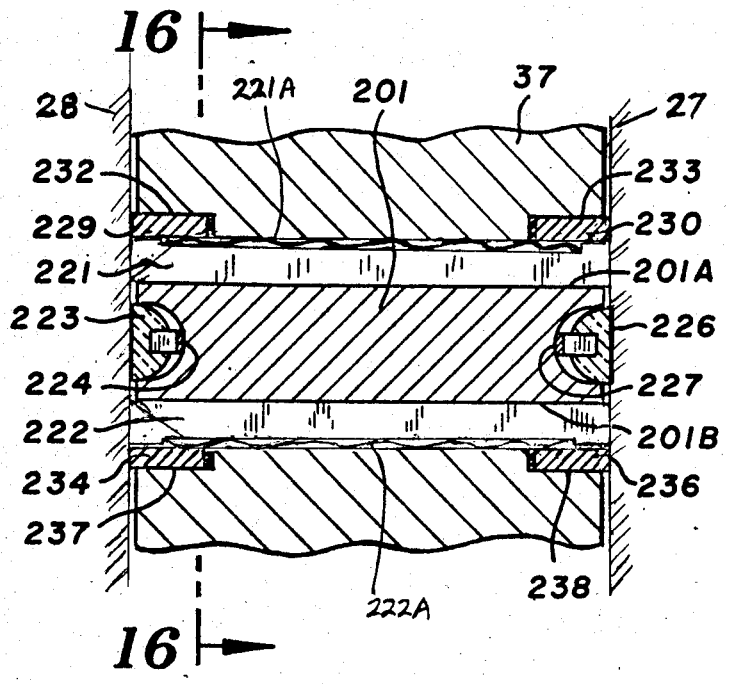
FIG. 15 is an enlarged sectional view taken along line 15—15 of FIG. 12.
Figure 16:
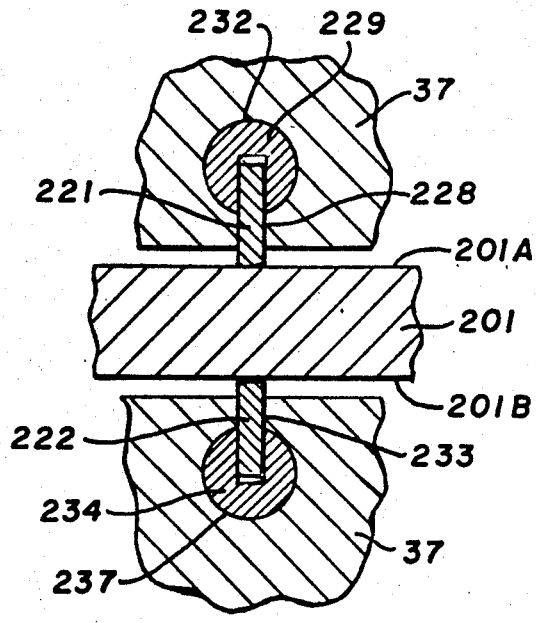
FIG. 16 is a sectional view taken along line 16—16 of FIG. 15.

The outer end of blade 201 has a continuous transverse groove 207 accommodating generally flat seal members 208 and 211. Seal members 208 and 211 may be ceramic material. Members 208 and 211, as shown in FIG. 13, have inclined engaging surfaces and generally flat ends whereby the seal members 208 and 211 can move laterally relative to each other to provide end seals that engage the inside surfaces of end plates 27 and 28. Seal member 208 has an inside end shoulder 209 facing an inside end shoulder 212 on seal member 211. A bow spring 216 located in groove 207 in engagement with shoulders 209 and 212 biases seal members 208 and 211 into continuous engagement with circumferential inner surface 26 of body 24. As shown in FIG. 12, the outer end 214 of blade 201 is chamfered such that it does not contact inner surface 26 of body 24.

Blade 201 is slidably mounted on two pairs of bearing seals 217, 218, and 219, 220. Seals 217–220 each have a semi-circular cross section and are mounted in a semi-circular groove in piston 37. The flat sides of seals 217–220 are in sliding engagement with the opposite sides 201A and 201B of the generally flat blade 201. As shown in broken lines in FIG. 13, seals 219 and 220 extend the entire width of blade 201. Seals 217 and 218 also extend across the width of blade 201. A pair of bar seals 221 and 222 are located outwardly of seals 218 and 220. Bar seals 221 and 222 bear against the opposite sides 201A and 201B of blade 201 so as to minimize the leakage of gas into slot 202. Seal 221 is a flat member located in a groove 228 and cylinders 229 and 230. Cylinders 229 and 230 are located in holes 232 and 233 in opposite sides of piston 37. Each cylinder has a groove accommodating bar seal 221 and wave spring 221A. Bar Seal 222 and wave spring 222A is located in a groove 233 in piston 37 and cylinders 234 and 236. Springs 221A and 222A bias seals 221 and 222 into engagement with opposite sides of blade 201. Cylinders 234 and 236 are located in holes 237 and 238 in piston 37. Each cylinder 234 and 236 has slot accommodating ends of bar seal 222. Seals 217-222 allow piston 37 to move relative to blade 201 and permit limited tilting of blade 201 in slot 202. This enhances seal life and ensures sealing engagement of seal members 208 and 211 on surface 26 of body 24.

A pair of end seals 223 and 226 are located adjacent opposite ends of blade 201. Bow springs 224 and 227, shown in FIGS. 13 and 14, bias end seals 223 and 227 into engagement with side plates 27 and 28, as shown in FIG. 13. End seals 223 and 226 each have a generally semi-circular cross section and are located in semi-circular grooves whereby blade 201 can have limited movement relative to piston 37 during the orbital movement of piston 37. As shown in FIG. 12, the outer end of seal member 226 has a slot 239 accommodating the end of seal member 211. Seal member 223 has a similar slot (not shown) accommodating the end of seal member 208. This provides continuous side seals for blade 201 engageable with the inside surfaces of end plates 27 and 28.

While there has been shown and described the preferred embodiment of the apparatus for pumping fluids and seal assemblies of the invention, it is understood that changes in the structure, materials, and parts may be made by those skilled in the art without departing from the invention. The invention is defined by the following claims.

The embodiments of the invention in which an exclusive property or privilege is claimed are defined as follows:

1. An apparatus for pumping a fluid comprising: housing means having an inner wall surrounding a chamber, means for controlling the flow of fluid into and out of said chamber, a piston means located within said chamber, eccentric means rotatably mounted on the housing means, said piston being rotatably mounted on the eccentric means whereby angular movement of the eccentric means moves the piston within the chamber, a plurality of seal assemblies movably mounted on said housing means, said seal assembly being located in sealing engagement with said inner wall of the housing means and arranged around said piston means to divide the chamber arcuate chamber segments, each seal assembly having blade means extended between the piston means and housing means, said piston means having generally radial movement relative to each seal assembly, each seal assembly and housing means having cooperating means for allowing limited arcuate movement of the seal assembly comprising a plurality of arcuate slots in said housing means open to the piston means and spaced radially inward of said inner wall, each slot having a radius that is substantially the same as the radius of the inner wall, each blade means having projection means extended into the aligned arcuate slots to restrict movement of the blade means and maintain the seal assembly in sealing engagement with said inner wall of the housing means during movement of the piston means in the chamber whereby said moving piston draws fluid into said chamber segments and pumps the fluid from said chamber segments.

2. The apparatus of claim 1 including: seal members on the outer ends of the blade means engageable with said inner wall of the housing means, and biasing means for biasing the seal members into engagement with said inner wall.

3. The apparatus of claim 1 wherein: said piston means has radial slots accommodating said seal assemblies.

4. The apparatus of claim 1 wherein: each blade means has a groove in the outer end thereof, a seal member located in said groove continuously engageable with said inner wall of the housing means, and means biasing the seal member into engagement with said inner wall.

5. The apparatus of claim 1 wherein: said eccentric means includes a plurality of eccentric members rotatably mounted on the housing means, each of said eccentric members being movably associated with said piston means.

6. The apparatus of claim 5 wherein: said plurality of eccentric members are circumferentially spaced from each other and radially spaced from the inner wall.

7. An apparatus for pumping a fluid comprising: housing means having a body with a cylindrical inner wall surrounding a chamber, a plurality of pairs of intake and exhaust valve means mounted on the body for controlling the flow of fluid into and out of said chamber, said pairs of intake and exhaust valve means being located around the body in communication with the chamber, shaft means rotatably mounted on the housing means, a piston located in said chamber, a first eccentric member secured to the shaft means, means mounting the piston on the first eccentric member, a second eccentric member rotatably mounted on the housing means, means mounting the piston on the second eccentric member, a third eccentric member rotatably mounted on the housing means, means mounting the piston on the third eccentric member, said second and third eccentric members being spaced from each other and radially spaced from the first eccentric member whereby on rotation of the shaft means the first eccentric member rotates the piston about an axis offset from the axis of rotation of the shaft means, said second and third eccentric members limiting the amount of angular movement of the piston as the piston moves within the chamber, a plurality of seal assemblies mounted on the housing means and located in said chamber, said seal assemblies being arranged around said piston to divide the chamber into separate arcuate segments and locate a seal assembly between each pair of intake and exhaust valve means, said piston having circumferentially spaced slots for each seal assembly whereby the piston moves relative to each seal assembly during movement of the piston in the chamber, each seal assembly having a seal means located in sealing engagement with said cylindrical inner wall, each of said seal means and housing means having cooperating means for allowing limited arcuate movement of the seal assembly and restrict radial movement thereof during movement of the piston, said body having side walls located adjacent opposite sides of the piston, said cooperating means comprising arcuate transversely aligned slots in said side walls open to opposite sides of the piston and spaced radially inward of said cylindrical inner wall, each of said slots having a radius that is substantially the same as the radius of the cylindrical inner wall, each seal means having projections extended into said aligned slots in the side walls to restrict radial movement of the seal assembly and maintain the seal means in sealing engagement with said cylindrical inner wall during movement of the piston in said chamber.

8. The apparatus of claim 7 wherein: the piston has an outer cylindrical surface surrounded by the cylindrical inner wall of the body, said piston having a diameter smaller than the diameter of the cylindrical inside wall.

9. The apparatus of claim 7 including: counterweight means mounted on the piston to balance said piston during movement thereof.

10. The apparatus of claim 9 wherein: said piston has a bore spaced from opposite sides of the second and third eccentrics, said counterweight means comprising a member located within said bore.

11. The apparatus of claim 7 wherein: each of seal means has a blade, said blade having side surfaces and an outer end, said outer end having a groove, a seal member located in said grove engageable with said inner wall of the body, means to bias the seal member into engagement with said inner wall of the body, said projections comprising opposite ends of cross bar means attached to said blade.

12. The apparatus of claim 11 including: seal means mounted on the piston engageable with opposite sides of the blades.

13. The apparatus of claim 7 wherein: each of said seal assemblies have a plurality of blades, said blades having adjacent engaging side surfaces allowing the blades to move relative to each other, said projections comprising opposite ends of cross bar means attached to each blade.

14. An apparatus for pumping a fluid comprising: housing means having a cylindrical inner wall surrounding a chamber, valve means for controlling the flow of fluid into and out of said chamber, a piston located within said chamber, means including first eccentric means rotatably mounted on the housing means, said piston being rotatably mounted on the first eccentric means whereby angular movement of the first eccentric means moves the piston within said chamber, second eccentric means rotatably mounted on the housing means, said piston being movably associated with said second eccentric means to limit angular movement thereof during its movement in the chamber, a plurality of seal assemblies movably mounted on said housing means, said seal assemblies being located in sealing engagement with said cylindrical inner wall of the housing means and arranged around said piston to divide the chamber into separate arcuate chamber segments, each seal assembly having blade means extended between the piston and housing means, said piston having general radial movement relative to each seal assembly, each seal assembly and housing means having cooperating means for allowing limited arcuate movement of the seal assembly and restrict radial movement thereof during movement of the piston whereby said moving piston draws fluid into said chamber segments and pumps the fluid from said chamber segments, said cooperating means comprising arcuate slots in said housing means open to the piston and spaced radially inward of said cylindrical inner wall, each of said slots having a radius that is substantially the same as the radius of the cylindrical inner wall, each blade means having projection means extended into the arcuate slots to restrict radial movement of the blade means and maintain the seal assemblies in sealing engagement with said cylindrical inner wall of the housing means during movement of the piston in the chamber.

15. The apparatus of claim 14 including: seal members on the outer ends of the blade means engageable with said inner wall of the housing means.

16. The apparatus of claim 14 wherein: said piston has radial slots accommodating said seal assemblies.

17. The apparatus of claim 16 including: seal means mounted on the piston engageable with said blade means.

18. The apparatus of claim 14 wherein: said blade means comprises a plurality of blades having adjacent side surfaces located in engagement with each other.

19. The apparatus of claim 18 wherein: each blade has a groove in the outer end thereof, seal members located in said groove continuously engageable with said inner wall of the body, and means biasing the seal members into engagement with said inner wall.

20. The apparatus of claim 18 wherein: said piston has radial slots accommodating said blades.

21. The apparatus of claim 14 wherein: said projection means comprise bar means secured to the blade means, said bar means having ends located in said slots.

22. The apparatus of claim 14 wherein: said second eccentric means comprises a pair of eccentric members rotatably mounted on the housing means, each of said eccentric members being movably associated with said piston.

23. The apparatus of claim 22 wherein: said pair of eccentric members are circumferentially spaced from each other and radially spaced from the first eccentric means.

24. A seal assembly for use with an apparatus for pumping fluid having a housing with an inner cylindrical wall surrounding a chamber, means for controlling the flow of fluid into and out of the chamber, a piston located within said chamber, and eccentric means movably mounting the piston on the housing whereby movement of the piston moves fluid into and out of said chamber wherein: said housing has side walls located adjacent opposite sides of the piston, said side walls having arcuate transversely aligned slots in said side walls open to opposite sides of the piston and spaced radially inward of said cylindrical inner wall, each of said slots having a radius that is substantially the same as the radius of the cylindrical inner wall, each seal assembly having at least one blade, cross bar means attached to said blade, said cross bar means having opposite ends projectable into transversely aligned slots to allow the blade to have limited arcuate movement and restricted radial movement thereof and maintain the blade in sealing engagement with said cylindrical inner wall during movement of the piston in the chamber.

25. The seal assembly of claim 24 wherein: each blade has an outer end, each outer end having a groove extended along the width thereof, and seal means located in each groove engageable with said inner cylindrical wall.

26. The seal assembly of claim 19 wherein: said piston has at least one generally radial slot to accommodate said seal assembly, said radial slot being generally aligned with aligned arcuate slots.

27. The seal assembly of claim 24 wherein: said blades comprises a pair of side by side blades having outer ends located adjacent the inner cylindrical wall, seal means associated with said outer ends engageable with said inner cylindrical wall.

28. The seal assembly of claim 24 wherein: said blades comprises a plurality of generally flat blades.

29. The seal assembly of claim 24 wherein: said blades have inner ends and outer ends, said cross bar means being secured to the inner ends of the blades, and seal means associated with the outer ends of the blades.

30. The seal assembly of claim 29 wherein: the outer ends of the blades have grooves along the transverse length thereof, said seal means being located in each groove, and biasing means acting on the seal means to move the seal means out of the groove.

31. A seal assembly for use with an apparatus for pumping fluid having a housing with a cylindrical inner wall surrounding a chamber, means for controlling the flow of fluid into and out of the chamber, a piston located within said chamber, and eccentric means movably mounting the piston on the housing whereby movement of the piston moves fluid into and out of said chamber wherein: said housing includes arcuate transversely aligned slots open to opposite sides of the piston and spaced radially inward of said cylindrical inner wall, each of said slots having a radius that is substantially the same as the radius of the cylindrical inner wall, each seal assembly having at least one blade movably mounted on the piston, said blade having opposite side surfaces, an inner end, and an outer end; cross bar means attached to said inner end of the blade, said cross bar means having opposite ends projectable into said transversely aligned slots to allow the blades to have limited arcuate movement and restricted radial movement thereof and maintain the blade in sealing engagement with said cylindrical inner wall during movement of the piston in the chamber.

32. The seal assembly of claim 31 including: seal means mountable on the piston engageable with opposite side surfaces of the blade.

33. The seal assembly of claim 31 wherein: said blade has side ends, and seal means mounted on said side ends engageable with said housing.

34. The seal assembly of claim 31 wherein: the outer end of the blade has a groove, seal means located in said groove engageable with said cylindrical wall, and biasing means located in said groove acting on the seal means to move the seal means out of the groove.

35. The seal assembly of claim 34 wherein: said seal means comprises first seal member and a second seal member, said biasing means being engageable with the first and second seal member.

36. The seal assembly of claim 34 wherein: said blade has side ends, and seal means mounted on said side ends engageable with said housing.

37. The seal assembly of claim 31 wherein: said blade has side ends and a groove in the outer end thereof, first seal means located within said groove engageable with said cylindrical wall, and second seal means mounted on the side ends engageable with the housing.

38. The seal assembly of claim 36 including: biasing means located in said first groove to bias the first seal means out of the groove.

* * * * *